US008876671B1

(12) United States Patent
Hurtato, Jr.

(10) Patent No.: US 8,876,671 B1
(45) Date of Patent: Nov. 4, 2014

(54) PUNCHING BAG ASSEMBLY

(76) Inventor: Abel Hurtato, Jr., Stockton, CA (US)

( * ) Notice: Subject to any disclaimer, the term of this patent is extended or adjusted under 35 U.S.C. 154(b) by 134 days.

(21) Appl. No.: 13/450,445

(22) Filed: Apr. 18, 2012

(51) Int. Cl.
*A63B 69/22* (2006.01)
*A63B 69/24* (2006.01)

(52) U.S. Cl.
USPC ..... 482/87

(58) Field of Classification Search
USPC ..... 482/83–90
See application file for complete search history.

(56) References Cited

U.S. PATENT DOCUMENTS

| | | | | | |
|---|---|---|---|---|---|
| 582,583 | A | * | 5/1897 | Fitzsimmons | 482/90 |
| 650,781 | A | * | 5/1900 | Currie | 482/86 |
| 717,273 | A | * | 12/1902 | Reach | 482/87 |
| 732,396 | A | * | 6/1903 | Cunningham | 482/87 |
| 732,740 | A | * | 7/1903 | Hansen | 482/90 |
| 829,257 | A | * | 8/1906 | Cary | 482/90 |
| 1,267,678 | A | * | 5/1918 | McArdle | 482/89 |
| 1,817,364 | A | * | 8/1931 | Goldsmith | 473/443 |
| 2,037,508 | A | * | 4/1936 | Gilman | 473/444 |
| 2,085,161 | A | * | 6/1937 | Kraus | 482/90 |
| 2,197,545 | A | * | 4/1940 | Bachman et al. | 473/444 |
| 2,237,599 | A | * | 4/1941 | Gilman | 473/444 |
| 2,249,309 | A | * | 7/1941 | Benko | 73/379.05 |
| 2,449,935 | A | * | 9/1948 | Gilman | 473/444 |
| 2,466,954 | A | * | 4/1949 | King | 473/443 |
| 2,643,124 | A | * | 6/1953 | Malone | 482/87 |
| 3,337,217 | A | * | 8/1967 | Cummins | 473/442 |
| 4,093,212 | A | | 6/1978 | Jacques | |
| 4,491,315 | A | * | 1/1985 | Dye | 482/86 |
| 4,527,796 | A | * | 7/1985 | Critelli | 482/86 |
| 5,046,724 | A | * | 9/1991 | Sotomayer | 482/90 |
| 5,183,450 | A | | 2/1993 | Stelmach | |
| 5,281,191 | A | | 1/1994 | DeSousa | |
| D377,201 | S | | 1/1997 | Howard | |
| 5,611,761 | A | * | 3/1997 | Brown | 482/87 |
| 5,769,761 | A | * | 6/1998 | Zagata, Jr. | 482/87 |
| D402,725 | S | * | 12/1998 | Anterhaus | D21/787 |
| 5,897,466 | A | * | 4/1999 | Capach | 482/83 |
| 5,941,801 | A | * | 8/1999 | D'Alto | 482/90 |
| 6,244,993 | B1 | * | 6/2001 | Dunn | 482/83 |
| 6,432,027 | B1 | * | 8/2002 | Haselrig | 482/83 |
| 7,244,219 | B1 | * | 7/2007 | Preciado | 482/90 |
| 7,390,288 | B2 | * | 6/2008 | Giaquinta et al. | 482/85 |
| 7,678,028 | B1 | * | 3/2010 | Gore | 482/89 |
| D675,696 | S | * | 2/2013 | Fu et al. | D21/798 |

(Continued)

FOREIGN PATENT DOCUMENTS

WO WO 9428981 A1 * 12/1994 ..... A63B 69/34

OTHER PUBLICATIONS

"Conical Frustum." mathworld.com. Feb. 12, 2006. <http://web.archive.org/web/20060212174221/http://mathworld.wolfram.com/ConicalFrustum.html>.*

*Primary Examiner* — Oren Ginsberg
*Assistant Examiner* — Garrett Atkinson

(57) ABSTRACT

A punching bag assembly is provided for facilitating simultaneous practice of body punching and uppercut punching. The assembly includes a first punching bag having an upper end and a lower end. At least one first bag chain is coupled to the first punching bag whereby the first punching bag is configured for being coupled to a support structure positioned above the first punching bag. A second punching bag has a central opening. The upper end of the first punching bag is inserted through the central opening such that the first punching bag extends through the second punching bag and the second punching bag is positioned proximate the upper end of the first punching bag.

10 Claims, 3 Drawing Sheets

(56) References Cited

U.S. PATENT DOCUMENTS

2009/0264263 A1* 10/2009 Yang ..... 482/85
2010/0093503 A1* 4/2010 Commeau ..... 482/87
2010/0179031 A1* 7/2010 Luigi ..... 482/89

* cited by examiner

PUNCHING BAG ASSEMBLY

BACKGROUND OF THE DISCLOSURE

1. Field of the Disclosure

The disclosure relates to punching bag devices and more particularly pertains to a new punching bag device for facilitating simultaneous practice of body punching an uppercut punching.

2. Summary of the Disclosure

An embodiment of the disclosure meets the needs presented above by generally comprising a first punching bag having an upper end and a lower end. At least one first bag chain is coupled to the first punching bag whereby the first punching bag is configured for being coupled to a support structure positioned above the first punching bag. A second punching bag has a central opening. The upper end of the first punching bag is inserted through the central opening such that the first punching bag extends through the second punching bag and the second punching bag is positioned proximate the upper end of the first punching bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
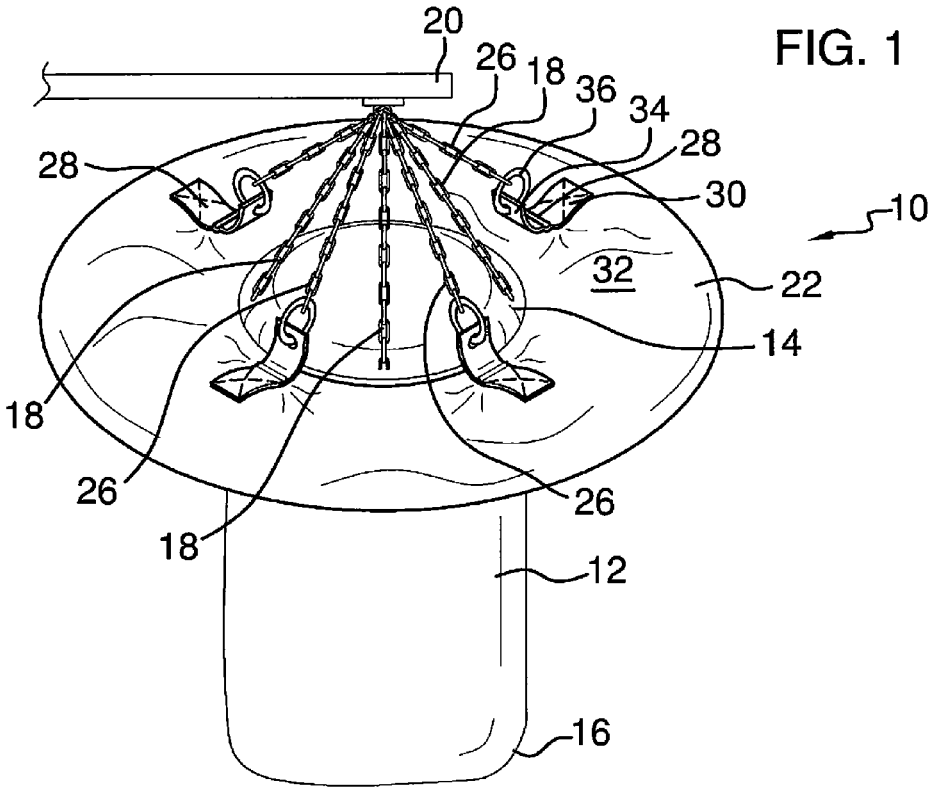
FIG. 1 is a top front side perspective view of a punching bag assembly according to an embodiment of the disclosure.
Figure 2:
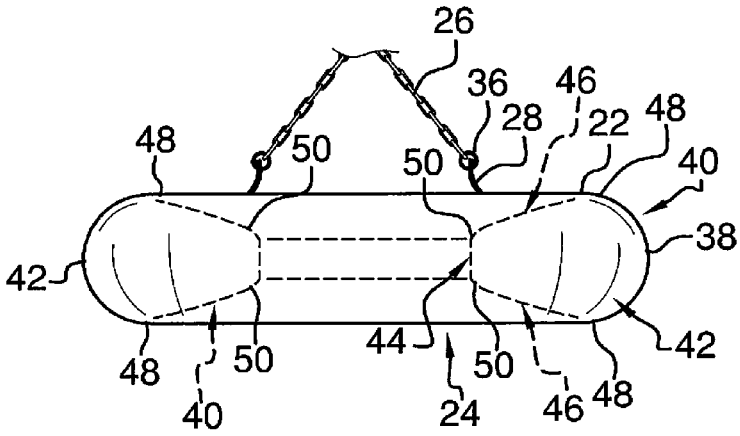
FIG. 2 is a side view of an embodiment of the disclosure.
Figure 3:
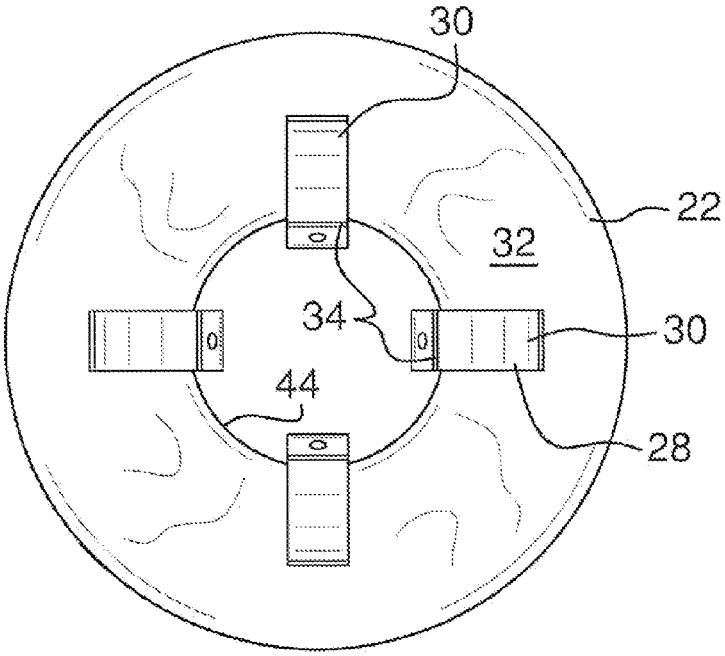
FIG. 3 is a top view of an embodiment of the disclosure.
Figure 4:
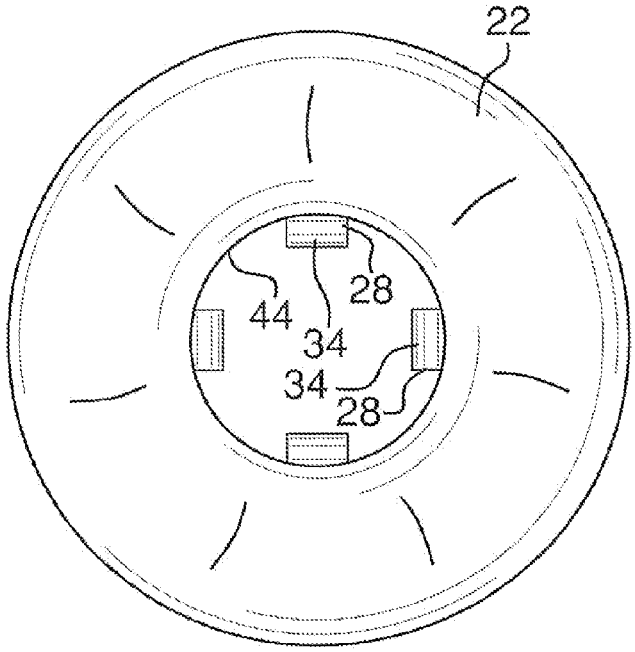
FIG. 4 is a bottom view of an embodiment of the disclosure.
Figure 5:
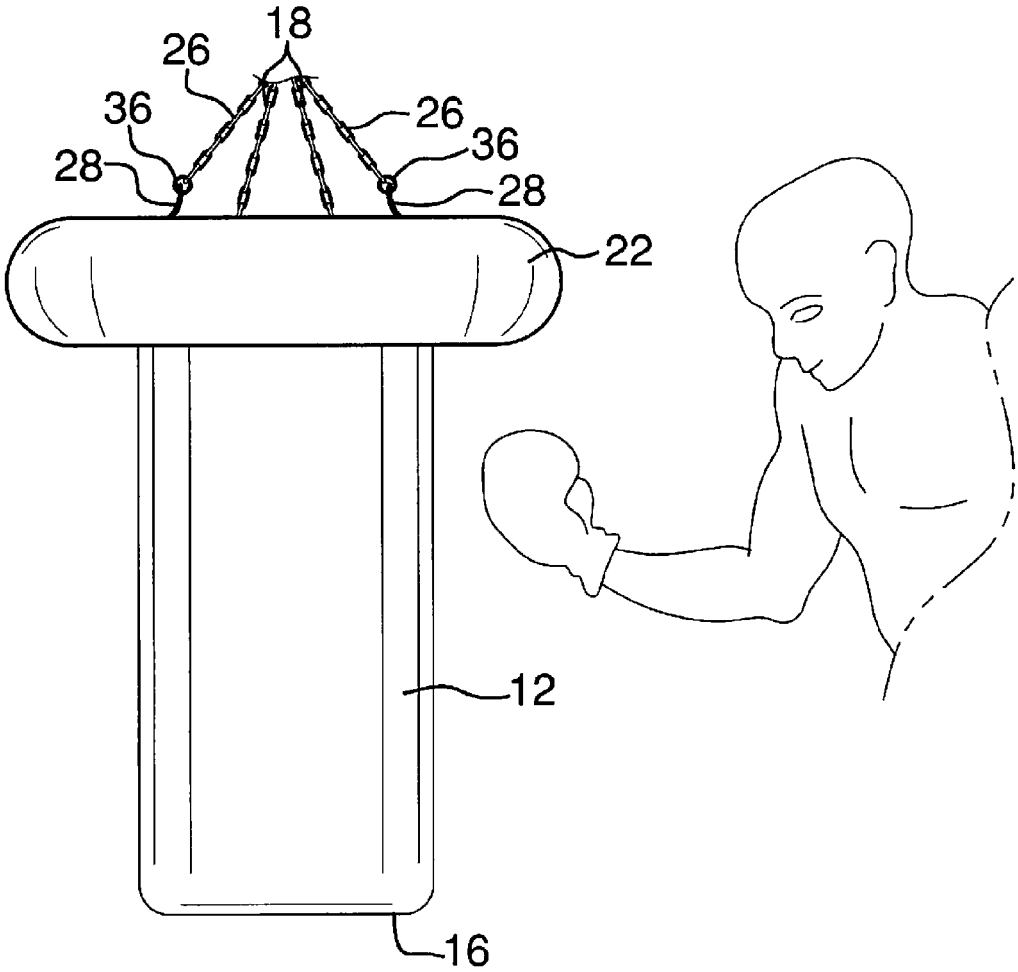
FIG. 5 is a side view of an embodiment of the disclosure in use.

With reference now to the drawings, and in particular to FIGS. 1 through 5 thereof, a new punching bag device embodying the principles and concepts of an embodiment of the disclosure and generally designated by the reference numeral 10 will be described.

As best illustrated in FIGS. 1 through 5, the punching bag assembly 10 generally comprises a first punching bag 12 having an upper end 14 and a lower end 16. The first punching bag 12 is of the type commonly referred to as a heavy punching bag being cylindrical and having an elongated vertical orientation. At least one first bag chain 18 is coupled to the first punching bag 12, typically by connection to the upper end 14. Multiple first bag chains 18 may be used or a single first bag chain 18 may be threaded to the first punching bag 12. Thus, the first punching bag 12 is configured for being coupled to a support structure 20 such as a ceiling or a stand having a beam positioned above the first punching bag 12.

A second punching bag 22 is provided for use in combination with the first punching bag 12. The second punching bag 22 has a central opening 24. The upper end 14 of the first punching bag 12 is inserted through the central opening 24 such that the second punching bag 22 is positioned proximate the upper end 14 of the first punching bag 12. The second punching bag 22 may be integrally joined or coupled directly to the first punching bag 12 and supported by the first bag chain 18. However, to provide connection to a pre-existing stand alone first punching bag 12, at least one second bag chain 26 may be coupled to the second punching bag 22 whereby the second punching bag 22 is similarly configured for being coupled to the support structure 20 above the second punching bag 22. Again, multiple separate second bag chains 26 may be utilized. A plurality of straps 28 is coupled to the second punching bag 22. Each second bag chain 26 is coupled to an associated one of the straps 28. Each strap 28 has a first end portion 30 coupled to a top surface 32 of the second punching bag 22. Each strap 28 further has a free end portion 34 extending from the second punching bag 22. A plurality of rings 36 may be provided. Each ring 36 is coupled between an associated one of the second bag chains 26 and the associated one of the straps 28.

The second punching bag 22 has an annular outer perimeter 38 and a radial cross-sectional shape 40 having a rounded outwardly facing surface 42, a flat inwardly facing surface 44, and a pair of straight sides 46 tapering from edges 48 of the outwardly facing surface 42 towards edges 50 of the inwardly facing surface 44.

In use, the second punching bag 22 is coupled to the first punching bag 12 with the first punching bag 12 extending through the second punching bag 22. A user may then punch the first punching bag 12 to practice punches to the body and, when desired, punch the second punching bag 22, which is positioned relative to the first punching bag 12 to allow practice of uppercut punches. Thus, the user may practice both body punching and uppercut punching in the same exercise.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

The invention claimed is:

1. A punching bag assembly comprising:

a first punching bag having an upper end and a lower end;

at least one first bag chain coupled to said first punching bag whereby said first punching bag is configured for being coupled to a support structure positioned above said first punching bag;

a second punching bag, said second punching bag having a central opening, said upper end of said first punching bag being inserted through said central opening, said second punching bag being positioned proximate said upper end of said first punching bag, said second punching bag forming a closed loop, said second punching bag extending around said upper end such that a horizontally oriented plane extending through said upper end also extends through said second punching bag;

at least one second bag chain coupled to said second punching bag whereby said second punching bag is configured for being coupled to the support structure above said second punching bag;

a plurality of said second bag chains;

a plurality of straps coupled to said second punching bag, each second bag chain being coupled to an associated one of said straps;

a plurality of rings, each ring being coupled between an associated one of said second bag chains and said associated one of said straps.

2. The assembly of claim 1, further including each said strap having a first end portion coupled to a top surface of said second punching bag.

3. The assembly of claim 2, further including each strap having a free end portion extending from said second punching bag.

4. The assembly of claim 1, further comprising said second punching bag having an annular outer perimeter.

5. The assembly of claim 4, further including a radial cross-sectional shape of said second punching bag having a rounded outwardly facing surface, a flat inwardly facing surface, and a pair of straight sides tapering from edges of said outwardly facing surface towards edges of said inwardly facing surface.

6. A punching bag assembly comprising:

a first punching bag having an upper end and a lower end;

at least one first bag chain coupled to said first punching bag whereby said first punching bag is configured for being coupled to a support structure positioned above said first punching bag;

a second punching bag, said second punching bag having a central opening, said upper end of said first punching bag being inserted through said central opening, said second punching bag being positioned proximate said upper end of said first punching bag;

a plurality of second bag chains coupled to said second punching bag whereby said second punching bag is configured for being coupled to the support structure above said second punching bag;

a plurality of straps coupled to said second punching bag, each second bag chain being coupled to an associated one of said straps, each said strap having a first end portion coupled to a top surface of said second punching bag, each strap having a free end portion extending from said second punching bag;

a plurality of rings, each ring being coupled between an associated one of said second bag chains and said associated one of said straps; and said second punching bag having an annular outer perimeter, a radial cross-sectional shape of said second punching bag having a rounded outwardly facing surface, a flat inwardly facing surface, and a pair of straight sides tapering from edges of said outwardly facing surface towards edges of said inwardly facing surface, said second punching bag extending around said upper end such that a horizontally oriented plane extending through said upper end also extends through said second punching bag.

7. A punching bag assembly comprising:

a first punching bag having an upper end and a lower end;

at least one first bag chain coupled to said first punching bag whereby said first punching bag is configured for being coupled to a support structure positioned above said first punching bag; and a second punching bag, said second punching bag having a central opening, said upper end of said first punching bag being inserted through said central opening, said second punching bag being positioned proximate said upper end of said first punching bag, said second punching bag forming a closed loop, said second punching bag extending around said upper end such that a horizontally oriented plane extending through said upper end also extends through said second punching bag;

a plurality of second bag chains coupled to said second punching bag whereby said second punching bag is configured for being coupled to the support structure above said second punching bag;

a plurality of straps coupled to said second punching bag, each second bag chain being coupled to an associated one of said straps; and each said strap having a first end portion coupled to a top surface of said second punching bag.

8. The assembly of claim 7, further including each strap having a free end portion extending from said second punching bag.

9. The assembly of claim 7, further comprising said second punching bag having an annular outer perimeter.

10. The assembly of claim 9, further including a radial cross-sectional shape of said second punching bag having a rounded outwardly facing surface, a flat inwardly facing surface, and a pair of straight sides tapering from edges of said outwardly facing surface towards edges of said inwardly facing surface.

* * * * *